US006030189A

United States Patent [19]

Bohm et al.

[11] Patent Number: 6,030,189

[45] Date of Patent: Feb. 29, 2000

[54] FRICTION VACUUM PUMP WITH INTERMEDIATE INLET

[75] Inventors: Thomas Bohm; Ralf Hirche, both of Cologne, Germany

[73] Assignee: Leybold Vakuum GmbH, Cologne, Germany

[21] Appl. No.: 09/051,893

[22] PCT Filed: Aug. 9, 1996

[86] PCT No.: PCT/EP96/03524

§ 371 Date: Apr. 17, 1998

§ 102(e) Date: Apr. 17, 1998

[87] PCT Pub. No.: WO97/15760

PCT Pub. Date: May 1, 1997

[30] Foreign Application Priority Data

Oct. 20, 1995 [DE] Germany ..... 295 16 599 U

[51] Int. Cl.[7] ..... F01D 1/36; F04D 25/00

[52] U.S. Cl. ..... 417/423.4; 417/250; 415/90

[58] Field of Search ..... 415/90; 73/40.7; 417/423.4, 250

[56] References Cited

U.S. PATENT DOCUMENTS

| | | | |
|---|---|---|---|
| 4,472,962 | 9/1984 | Mennenga | 73/40.7 |
| 4,550,593 | 11/1985 | Reich | 415/90 |
| 4,655,678 | 4/1987 | Miki | 415/90 |
| 4,826,393 | 5/1989 | Miki | 415/90 |
| 4,832,564 | 5/1989 | Holss et al. | 415/90 |
| 4,919,599 | 4/1990 | Reich et al. | 415/90 |
| 5,695,316 | 12/1997 | Schutz et al. | 415/90 |
| 5,733,104 | 3/1998 | Conrad et al. | 417/250 |

FOREIGN PATENT DOCUMENTS

| | | |
|---|---|---|
| 0408792 | 1/1991 | European Pat. Off. . |
| 0478882 | 4/1991 | European Pat. Off. . |
| 1403493 | 1/1969 | Germany . |
| 2119857 | 11/1972 | Germany . |
| 2214702 | 9/1973 | Germany . |
| 2442614 | 3/1976 | Germany . |
| 3124205 | 12/1982 | Germany . |
| 9304435 | 7/1993 | Germany . |
| 3722164 | 4/1995 | Germany . |
| 2206648 | 1/1989 | United Kingdom . |

*Primary Examiner*—Willis R. Wolfe
*Attorney, Agent, or Firm*—Wall Marjama Bilinski & Burr

[57] ABSTRACT

The invention concerns a friction vacuum pump (1) with an inlet (11), an outlet (20) and a rotor (6, 7) and stator (14, 21) which are located between the inlet (11) and the outlet (20) and carry blades (7 and 8), respectively. In order to design an intermediate inlet (28), which passes into an annular channel (31) surrounding the stator and rotor blades (7 and 8), respectively, so that it is simple and effective, the invention proposes that the stator (21) consists of annular blades or blade segments (25) and annular spacers (22, 23, 24), the outer edges (26) of the annular blades or blade segments (25) being located between the spacers (22, 23, 24) and at least one spacer (23, 24) located at the height of the annular channel (31) having perforations (32) in it.

4 Claims, 2 Drawing Sheets

FIG. 2
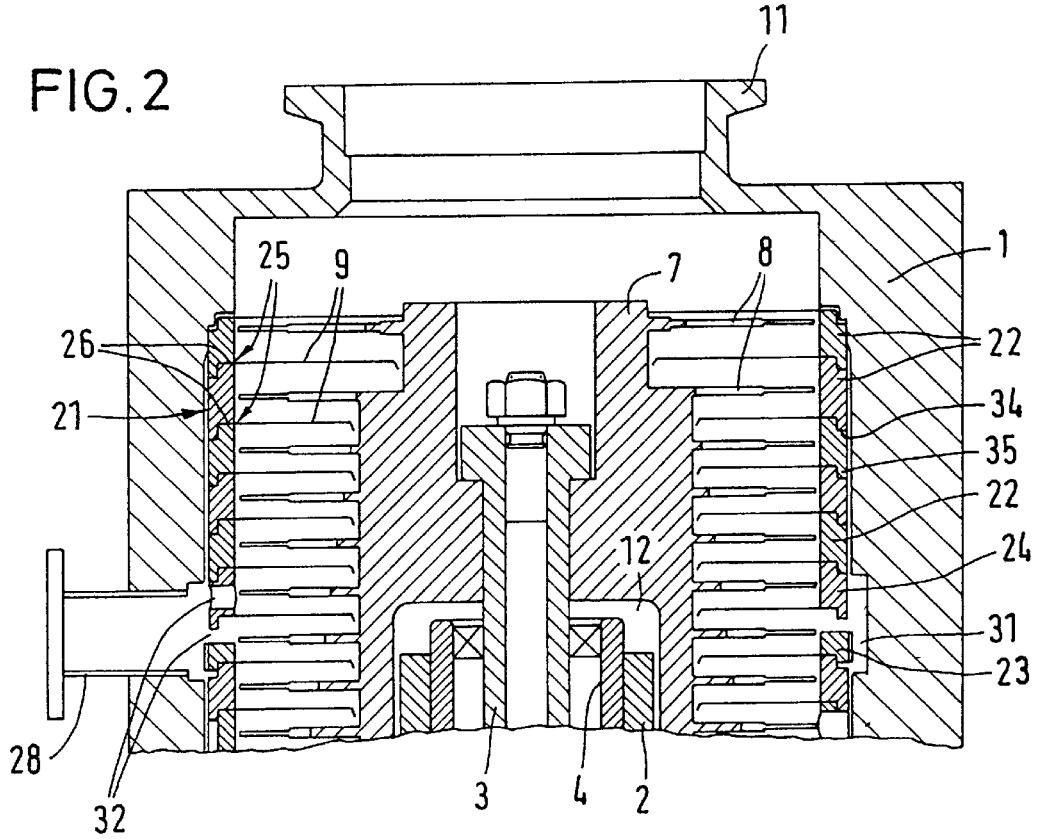
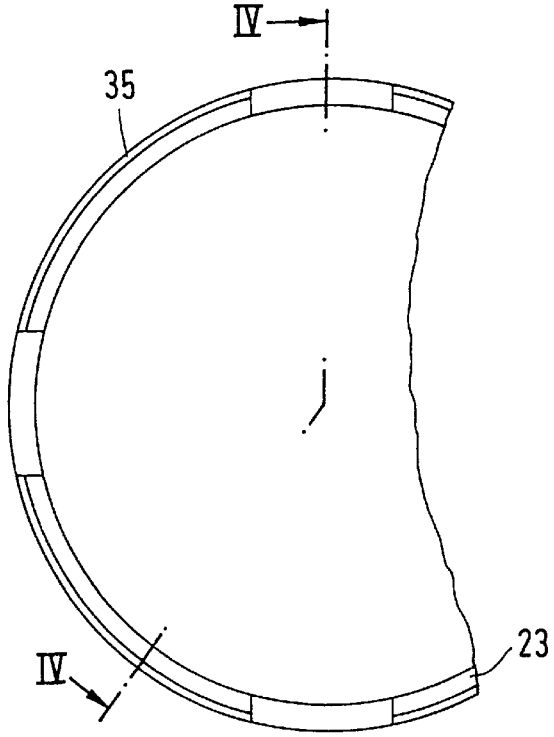
FIG. 3
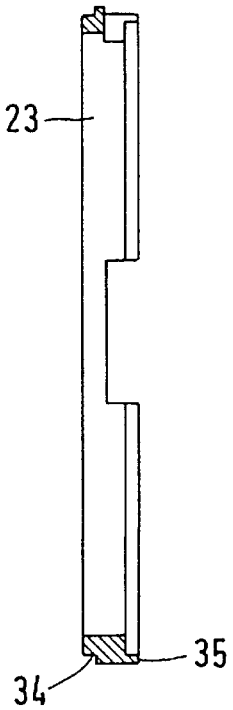
FIG. 4

FRICTION VACUUM PUMP WITH INTERMEDIATE INLET

BACKGROUND OF THE INVENTION

The present invention concerns a friction vacuum pump having the characteristics of patent claim 1.

A friction vacuum pump of this kind is known from DE-A-31 24 205. As to the design of the opening of the intermediate inlet into the pumping chamber of the friction pump, it is stated that it is advantageous to provide an annular channel.

It is the task of the present invention to design the opening of the intermediate inlet into the pumping chamber of the friction vacuum pump in a preferred manner while at the same time taking two aspects into account. On the one hand the stator forming components in the area of the annular channel shall be designed in such a manner that they obstruct the gases entering into the pumping chamber as little as possible. On the other hand simple production of the components in the area of the annular channel shall be ensured.

SUMMARY OF THE INVENTION

This task is solved through the present invention by the characteristic features of the claims. A stator of the kind according to the present invention differs only slightly from a stator for a friction pump without an intermediate inlet. It is only required to equip an annular spacer being present at the height of the annular channel with perforations—bore holes, milled openings or alike. Other differences do not exist, be they in respect to the way in which the stator is manufactured or the way in which it is fitted, so that the complexity of manufacturing a friction vacuum pump with an intermediate inlet is only insignificantly greater compared to a friction pump without an intermediate inlet. One annular spacer may be equipped with a multitude of perforations. It is particularly advantageous for the annular spacer to have several sections which are reduced in height. The total of these sections may amount to 20 to 80% of the circumference of the annular spacer, so that the conductance of the perforations can be designed to be very high without impairing the stability of the stator.

BRIEF DESCRIPTION OF THE DRAWINGS

Further advantages and details of the present invention shall be explained by reference to the design examples of drawing FIGS. 1 to 4. Shown in drawing FIG. 2 is a further design example, drawing FIG. 3 is a top view on to an annular spacer of the stator for the design example according to drawing FIG. 2 and drawing FIG. 4 is a section through the annular spacer according to drawing FIG. 3 along the line IV—IV.

DESCRIPTION OF THE INVENTION

Figure 1:
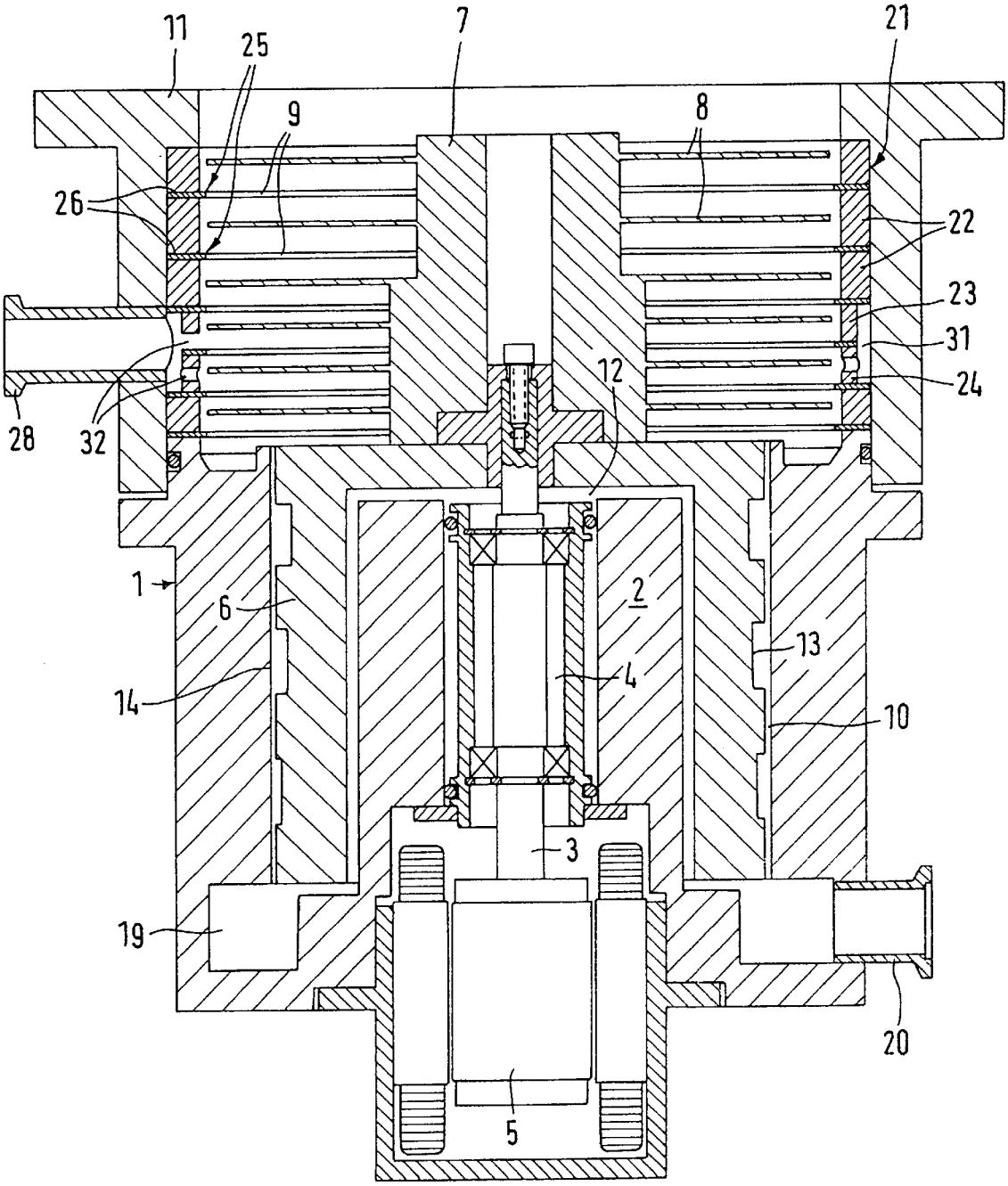
FIG. 1 is a design example for a friction vacuum pump according to the present invention, drawing

In the design example according to drawing FIG. 1 the outer casing is designated as 1. It is equipped with a bearing bush 2 which extends inwards, supporting a shaft 3 by means of a spindle bearing arrangement 4. Coupled to the shaft 3 are the drive motor 5, the rotor 6 of a molecular pumping stage as well as the rotor 7 of a turbomolecular pumping stage. The rotor 7 is equipped with the rotor blades 8, which together with the stator blades 9 suspended within casing 1, form the turbomolecular pumping stage. By means of flange 11 the particular pump is connected to the vacuum chamber which is to be evacuated.

The molecular pump (or molecular pumping stage) comprises bell-shaped rotor 6 which embraces the bearing space 12, whereby said rotor is equipped on its outside with thread-like grooves 13, in which during operation of the pump the gas is conveyed from the high vacuum side to the forevacuum side. Assigned to the rotor 6 is a stator having approximately the same axial length. Located between the stator 14 and the rotor 6 is a slot 10. This slot needs to be as small as possible in order to attain a seal between the thread-like grooves which is as good as possible. The forevacuum port 20 is connected to the forevacuum chamber 19.

Stator blades 9 and annular spacers 22 to 24 belong to the stator 21 of the turbomolecular pump. The stator blades 9 are—in a manner which is basically known—part of the annular blades or blade segments 25 with outer edges 26, which in the assembled state of the stator are located between the annular spacers. The stator, which is composed of annular spacers 22 and blade segments 25 arranged in alternating fashion, is centred by the outer casing 1.

The turbomolecular pumping stage 8, 9 is equipped with an intermediate inlet 28 which may serve different purposes—for example, generating a vacuum at a pressure level which is higher compared to that in the vacuum chamber which is not shown and which is connected to flange 11, or for admitting the search gas when using the pump in a counterflow leak detector. The annular spacers 23, 24 located at the height of the intermediate inlet 28 are modified compared to the other annular spacers 22.

One or both annular spacers 23 or 24 have a reduced outside diameter and form, jointly with the casing 1, the annular channel 31 into which the intermediate inlet 28 opens. Moreover, the annular spacer(s) 23 or 24 with a reduced outside diameter are equipped with perforations 32 which provide the link between the pumping chamber of the turbomolecular pumping stage and the intermediate inlet 28. These perforations may, for example, consist of several bores, like in the case of annular spacer 24. An other possibility is to process annular spacer 23 by milling it in such a way that sections of it are reduced in their (axial) height. Thus perforations having a high conductance can be manufactured.

Shown in drawing FIGS. 2 to 4 is a design example in which the annular spacers 22 to 24 are equipped with centering means. These means consist of an outer circumferential recess 34 on one side and an edge 35 orientated in the axial direction on the other side of the annular spacers. The dimensions are so selected that the edge 35 on the one hand embraces the outer edge 26 of the adjacent annular blade segment 25, thereby centering it. Moreover, the outer edge 35 extends into the recess 34 of the adjacent annular spacer, thereby centering the entire stator 21.

In the design example according to drawing FIG. 2, the annular channel 31 is formed as a circular groove within casing 1, so that it is not required to reduce the outside diameters of annular spacers 23 or 24. In the case of annular spacer 24, the perforations are, for example, again provided by means of bores. The annular spacer 23 is shown once more in drawing FIGS. 3 and 4. It is equipped with the centering means (outer edge 35, recess 34). The perforations 32 are formed by several sections of the annular spacer which are reduced in height. In the presented design example there are 4 sections of this kind which are evenly distributed along the circumference and which each amount to 10% of the circumference.

We claim:

1. A friction pump that includes a stator means having a central opening containing a rotor means rotatable contained within the opening in said stator means, an inlet located at one end of said stator means, an outlet located at the other end of said stator means and an intermediate inlet located in said stator means between the inlet and the outlet, said stator means containing a series of annular spacers mounted inside said opening and annular stator blades captured between the spacers that extend into a turbo-molecular pumping chamber between the stator and rotor means, and said stator means further containing an annular channel formed therein at the entrance to the intermediate inlet and at least one of said s pacers located adjacent to the annular channel containing perforations therein linking the annular channel and the turbo-molecular chamber, wherein said annular channel is a groove formed in part by the inner wall of the stator means that faces the annular spacers, and where at least one annular spacer faces said annual channel and contains a reduced outer diameter whereby the annular channel is widened at the entrance to the intermediate inlet with at least one annular spacer adjacent to the annular channel containing perforations.

2. A friction pump that includes a stator means having a central opening containing a rotor means rotatably contained within the opening in said stator means, an inlet located at one end of said stator means, an outlet located at the other end of said stator means and an intermediate inlet located in said stator means between the inlet and the outlet, said stator means containing a series of annular spacers mounted inside said opening and annular stator blades captured between the spacers that extend into a turbo-molecular pumping chamber between the stator and rotor means, and said stator means further containing an annular channel formed therein at the entrance to the intermediate inlet and at least one of said spacers located adjacent to the annular channel containing perforations therein linking the annular channel and the turbo-molecular chamber, wherein said annular channel is a groove formed in part by the inner wall of the stator means that faces the annular spacers, and where at least one annular spacer faces said annual channel and contains a reduced outer diameter whereby the annular channel is widened at the entrance to the intermediate inlet with at least one annular spacer adjacent to the annular channel containing perforations, wherein a spacer containing said perforations has several sections that are reduced in thickness.

3. A friction pump that includes a stator means having a central opening containing a rotor means rotatably contained within the opening in said stator means, an inlet located at one end of said stator means, an outlet located at the other end of said stator means and an intermediate inlet located in said stator means between the inlet and the outlet, said stator means containing a series of annular spacers mounted inside said opening and annular stator blades captured between the spacers that extend into a turbo-molecular pumping chamber between the stator and rotor means, and said stator means further containing an annular channel formed therein at the entrance to the intermediate inlet and at least one of said spacers located adjacent to the annular channel containing perforations therein linking the annular channel and the turbo-molecular chamber, wherein said annular channel is a groove formed in part by the inner wall of the stator means that faces the annular spacers, and where at least one annular spacer faces said annual channel and contains a reduced outer diameter whereby the annular channel is widened at the entrance to the intermediate inlet with at least one annular spacer adjacent to the annular channel containing perforations, wherein a spacer containing said perforations has several sections that are reduced in thickness, wherein said sections are distributed along the circumference of said spacer, said sections extending over about 5% to 15% of the entire circumference of the spacer.

4. A friction pump that includes a stator means having a central opening containing a rotor means rotatably contained within the opening in said stator means, an inlet located at one end of said stator means, an outlet located at the other end of said stator means and an intermediate inlet located in said stator means between the inlet and the outlet, said stator means containing a series of annular spacers mounted inside said opening and annular stator blades captured between the spacers that extend into a turbo-molecular pumping chamber between the stator and rotor means, and said stator means further containing an annular channel formed therein at the entrance to the intermediate inlet and at least one of said spacers located adjacent to the annular channel containing perforations therein linking the annular channel and the turbo-molecular chamber, wherein said annular channel is a groove formed in the inner wall of the stator means that faces the annular spacers.

* * * * *